US007165713B2

(12) United States Patent
Allee

(10) Patent No.: US 7,165,713 B2
(45) Date of Patent: Jan. 23, 2007

(54) FORMABLE POCKET FOR PRESENTATION FOLDERS

(75) Inventor: Randy L. Allee, Fort Scott, KS (US)

(73) Assignee: Ward/Kraft, Inc., Fort Scott, KS (US)

( * ) Notice: Subject to any disclaimer, the term of this patent is extended or adjusted under 35 U.S.C. 154(b) by 541 days.

(21) Appl. No.: 10/724,250

(22) Filed: Nov. 26, 2003

(65) Prior Publication Data

US 2005/0109824 A1 May 26, 2005

(51) Int. Cl.
*B65D 27/00* (2006.01)
*B65D 27/08* (2006.01)

(52) U.S. Cl. ..... 229/67.1; 229/72

(58) Field of Classification Search ..... 229/67.1, 229/67.3, 92–92.3, 72, 74, 301; 281/29, 281/31, 37; 402/73
See application file for complete search history.

(56) References Cited

U.S. PATENT DOCUMENTS 1,434,097 A * 10/1922 Conner ..... 229/68.1
3,837,565 A * 9/1974 Johnsen ..... 229/301
3,870,223 A 3/1975 Wyant
4,109,850 A 8/1978 Meenan et al.
4,301,962 A 11/1981 Monckton et al.
4,703,952 A 11/1987 Biasini
4,708,285 A * 11/1987 Segall ..... 229/68.1
4,731,142 A 3/1988 Stenner
4,913,462 A 4/1990 Parker
4,971,361 A 11/1990 Whiting
4,989,777 A 2/1991 Miller
5,042,843 A 8/1991 Kuhns et al.
5,050,792 A * 9/1991 Segall ..... 229/68.1
5,090,732 A 2/1992 Kuhns et al.
5,333,780 A * 8/1994 Scott ..... 229/75
5,348,216 A * 9/1994 Scott ..... 229/75
5,405,473 A 4/1995 Kuhns
5,439,436 A 8/1995 Moll
5,447,333 A 9/1995 Kuhns et al.
5,562,309 A 10/1996 Brink et al.
5,579,908 A * 12/1996 Johnson ..... 206/308.3
5,598,969 A * 2/1997 Ong ..... 229/67.1
5,836,507 A 11/1998 Mueller et al.
5,882,038 A 3/1999 Ong
5,890,774 A 4/1999 Schwartz
6,059,316 A * 5/2000 Whittington ..... 281/38
6,063,226 A 5/2000 Foster et al.
6,209,778 B1 * 4/2001 Henrikson et al. ..... 229/67.1
6,241,285 B1 * 6/2001 Duhr-Kravitz et al. ..... 281/29

(Continued)

*Primary Examiner*—Jes F. Pascua
(74) *Attorney, Agent, or Firm*—Michael C. Maier

(57) ABSTRACT

The present invention relates to a sheet of stock material that is suitable for use in creating personalized pockets and or pockets on demand for presentation folders as well as auxiliary pockets for existing product folders, notebooks and containers. More particularly, the instant invention provides the small office, home office user ("SOHO"), as well as the manufacturer of presentation folders and the presenter of products, services and educational subjects with the ability to create personalized pockets on demand and in limited quantities. The subject pocket of the present specification is provided in sheet form, with one or more strips of adhesives and available removable segments in order to create pockets that can be imprinted or imaged with specific or personalized communications or messages in order to create a significantly greater message transmission vehicle for the advancement of product, services, topics, concepts, theories or ideas.

19 Claims, 7 Drawing Sheets

U.S. PATENT DOCUMENTS 6,244,627 B1 6/2001 Wolff et al.
6,415,976 B1 * 7/2002 Flynn et al. ..... 229/71
6,536,803 B2 3/2003 Masson
6,666,610 B1 * 12/2003 Moor et al. ..... 402/79

* cited by examiner 13
32*
15

100
24
21
32*
23
11
WELCOME RANDY
13
30

13
15

100
27
30
25
11
CONGRATULATIONS
15
23
21
32*

FORMABLE POCKET FOR PRESENTATION FOLDERS

CROSS-REFERENCES TO RELATED APPLICATIONS

None.

FIELD OF THE INVENTION

The present invention relates to a sheet of stock material that is suitable for use in creating personalized pockets and or pockets on demand for presentation folders as well as auxiliary pockets for existing product folders, notebooks and containers. More particularly, the instant invention provides the small office, home office user ("SOHO"), as well as the manufacturer of presentation folders and the presenter of products, services and educational subjects with the ability to create personalized pockets on demand and in limited quantities. The subject pocket of the present specification is provided in sheet form, with one or more strips of adhesives and available removable segments in order to create pockets that can be imprinted or imaged with specific or personalized communications or messages in order to create a significantly greater message transmission vehicle for the advancement of product, services, topics, concepts, theories or ideas.

BACKGROUND OF THE INVENTION

Stock folders are generally well known today and are provided in a variety of colors and in standard formats. Such stock products are created from a blank of material to which at least one and usually two pockets are provided on the inner face of the blank. The pockets are generally formed from the same sheet or blank and are then folded over onto the blank and sealed to the blank to create the pocket.

Such folders are used in a number of applications from academic, such as in a elementary, middle school, high school or collegiate environment to education purposes including seminars and technical symposiums. In addition, folders have also been used in the past to hand out information on products and services in the hopes of inducing purchases or sales of such products or services.

These prior art folders are provided in a broad spectrum of colors and can even have different finishes such as glossy or a metallic appearance in order to supplement the product of topic offering. In addition, such prior art products may also be provided with textural or tactile features so as to resemble grains in leather or wood, again all in an effort to produce or tailor the communication vehicle to the audience or presenter to garner more attention for the products or services being offered.

Examples of such prior art folders include U.S. Pat. Nos. 3,870,223, 4,109,850, 4,301,962, 4,731,142, 4,989,777 and 5,836,507. Each of these prior art constructions are constructed from a single blank of material. That is, the portion making up the folder and which comprises the pocket are part of the same blank. The portion which becomes the pocket is then folded onto the folder portion to create the pocket portion. Such constructions normally require the manufacturer to purchase expensive and complicated folding equipment in order to process and fold the pocket portion, see for example U.S. Pat. Nos. 5,439,436 and 6,063,226.

One of the difficulties with such stock folder products is that the user of such products must order the folders in large lots, or must select from a generic stock inventory that may only have a predetermined number of colors or finish options. If a presenter or distributor would prefer to have at least limited information printed on the folder, such as the name of the company or presenter or to have certain colors or finishes that represent the company, such as to emphasize the trade dress, then the user is stuck with the unfortunate option of having to order such products in large quantities typically greater than 50 and more often in the hundreds as the set up for the production folders is complex and orders in the hundreds of units is normally required by the manufacturer due to the complexity associated with such set up of equipment. This dilemma has thwarted the growth of the folder industry and prevented the use of this tool from expanding its communication potential to users of the product.

Attempts at personalization or individualization have sometimes been elaborate, such as that illustrated by U.S. Pat. No. 5,882,038 in which a personalized sheet is printed and then inserted so that the personalized information is then visible through die cut windows in the blank. As one might imagine, this limits the amount of personalization that can be provided and also requires that the information be aligned with the windows in the folder assembly so that it is visible. In addition, to the steps of folding the blank and the equipment required therefore, in order to manufacture such a product one needs to add additional die cutting stations and then is faced with the challenge of inserting the personalized sheet of information. In preparing for a meeting, even a small meeting, having to insert 10 sheets into 10 different folders can be time consuming, particularly if one is rushed in trying to get to the meeting.

The foregoing prior art products also suffer from the fact that they are provided only in standard configurations, choices of only one or two products having only one or two pockets. This may require the presenter to over stuff the pockets provided with the folder or alternatively to have to distribute multiple folders in order to achieve the communication that is intended, that is in order to discuss multiple products or services multiple folders need to be provided to the attendees of the meeting. In addition, attendees may also wish to include materials collected at the event such as notes, brochures or other collateral material and are faced with stuffing the material into already tight spaces or simply dropping them internally of the folder which can lead to the materials being lost as they are not secured by a pocket. The ability to add additional pockets or the ability to position pockets in different areas of the folder is simply not an option or if it is it may be an expensive option requiring the manufacturer to purchase additional equipment, rework existing equipment or obtain further tooling in order to produce what may only be a single order.

Another other problem faced by users of such stock folders is that they have virtually no personalized or individualized information. For example, in a typical introductory business meeting between two entities, the attendees may include an executive, members of sales and marketing and production personnel. Distributing the exact same information to each attendee may result in the information simply being deposited into the attendee's files, instead of the presenter's intent of delivering a specific message to each participant. In addition, any printing that can occur is limited to the amount of space of the blank not covered by the pocket. That is, when processed, blanks are printed on one side (simplex printed) and when the pocket is folded over the blank any printing would be limited only to the upper portion of the blank, thereby limiting the amount of information that can be received by the recipient.

Publications, patents and patent applications are referred to throughout this disclosure. All references cited herein are hereby incorporated by reference.

What is needed therefore is a product that can be produced in a convenient manner that overcomes the foregoing drawbacks. In addition, what is needed is a product that can be customized and tailored to the individual needs of a customer or presenter and one which enables the customer or presenter to convey personalized or individualized messages so as to increase the impact of the delivered materials.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention provides the user the ability to create individualized and or personalized pockets that can be attached to blanks that are used as presentation folders or to document containment devices so as to serve as auxiliary pockets to contain overflow or additional information. The sheet of material that can be used to form the pocket can be printed with personalized or individualized information similar to that which is applied to the blank making up the folder or to inserts that may be inserted into sleeves of document containment devices so that the product appears as if it was manufactured as an integral unit and has a professional appearance as well as one that is tailored to the individual recipient.

In one embodiment of the present invention, a sheet for use in creating a pocket for folders is described and includes a sheet of material suitable for receiving printing or imaging. The sheet has a first face and a second face and first and second transversely extending edges and first and second longitudinally extending edges. There are at least first and second strips of adhesive disposed adjacent one of the first and second transversely extending edges or the first and second longitudinally extending edges with each of the first and second strips of adhesive having first and second edges.

The presently described embodiment also includes at least first and second lines of weakness with the first line of weakness being disposed along one of the first and second edges of each of the first and second strips of adhesive. The second line of weakness is disposed substantially perpendicularly to the first line of weakness and runs from the first edge to the second edge of each of the first and second strips of adhesive. This embodiment also includes a fold line that runs between one of the first and second transversely extending edges or the first and second longitudinally extending edges.

The present invention uses the lines of weakness to create first and second sections in the adhesive as well as first and second removable portions. Through the cooperating use of the lines of weakness, a portion from each side of the form (whether extending in the transverse or longitudinal direction) can be removed in order to create the pocket arrangement of the present invention and as will be further described in the detailed description set forth herein. The second line of weakness is disposed substantially perpendicularly to the first line of weakness to form the sections and removable portions.

The fold line of the presently described embodiment is generally disposed medially of the sheet, but it should be understood, depending on the pocket configuration, the fold line can be used to create majority and minority portions of the sheet, (one having greater than 50% and the other having less than 50% of the sheet material).

In a still further embodiment of the present invention, a personalized presentation folder having at least one pocket formed from a separate sheet of material is described and includes a blank of material sized and configured to provide a presentation folder and suitable for printing through a printing means capable of producing variable print. A separate sheet of material suitable for receiving printing or imaging and for forming the pocket is also provided. The sheet has a first face and a second face and first and second transversely extending edges and first and second longitudinally extending edges. There are at least first and second strips of adhesive disposed adjacent one of the first and second transversely extending edges or the first and second longitudinally extending edges with each of the first and second strips of adhesive having first and second edges.

The presently described embodiment also includes at least first and second lines of weakness with the first line of weakness being disposed along one of the first and second edges of each of the first and second strips of adhesive. The second line of weakness is disposed substantially perpendicularly to the first line of weakness and runs from the first edge to the second edge of each of the first and second strips of adhesive. This embodiment also includes a fold line that runs between one of the first and second transversely extending edges or the first and second longitudinally extending edges. The sheet with the first and second strips of adhesive, fold lines and lines of weakness being formed into a pocket which can be attached to the blank. The printing that is applied to the blank and the sheet containing personalized or individualized information.

In this embodiment the printing on the sheet and the blank can be complimentary to one another, that is the printing conveys a common, theme, message or has elements on one of the blank or sheet that are in common with elements printed on the other blank or sheet so as to create mating or complimentary personalized or individualized messages or communications.

In yet a still further embodiment of the present invention personalized auxiliary pocket for a document containment device is described and includes a document containment device having at least one surface suitable for accepting an auxiliary pocket. The auxiliary pocket is formed from a separate sheet suitable for receiving printing or imaging and for forming the pocket is also provided. The sheet has a first face and a second face and first and second transversely extending edges and first and second longitudinally extending edges. The printing or imaging that is provided on the sheet relates to information contained within the document containment device or to a user or supplier of the document containment device. There are at least first and second strips of adhesive disposed adjacent one of the first and second transversely extending edges or the first and second longitudinally extending edges with each of the first and second strips of adhesive having first and second edges.

The presently described embodiment also includes at least first and second lines of weakness with the first line of weakness being disposed along one of the first and second edges of each of the first and second strips of adhesive. The second line of weakness is disposed substantially perpendicularly to the first line of weakness and runs from the first edge to the second edge of each of the first and second strips of adhesive. This embodiment also includes a fold line that runs between one of the first and second transversely extending edges or the first and second longitudinally extending edges. The sheet with the first and second strips of adhesive, fold lines and lines of weakness being formed into the auxiliary pocket which can be attached to the document containment device.

In a still further embodiment of the present invention, a hinged pocket assembly for presentation folders is provided and includes a blank of material suitable for use as a presentation folder and a sheet of material suitable for receiving printing or imaging and for forming a pocket. The sheet has a first face and a second face and first and second transversely extending edges and first and second longitudinally extending edges.

The presently described embodiment includes at least first and second strips of adhesive disposed adjacent one of the first and second transversely extending edges or the first and second longitudinally extending edges with each of the first and second strips of adhesive having first and second edges defining an adhesive area. The sheet of this embodiment is provided with at least first and second lines of weakness, with the first line of weakness disposed along one of the first and second edges of each of the first and second strips of adhesive.

This embodiment provides that one of the first and second strips of adhesive is used to seal an end of the sheet when the sheet is in a folded condition to form the pocket and another of the first and second strips of adhesive serves as a hinge which can be attached to the blank of material so as to enable the pocket to be moved from a first position to a second position.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
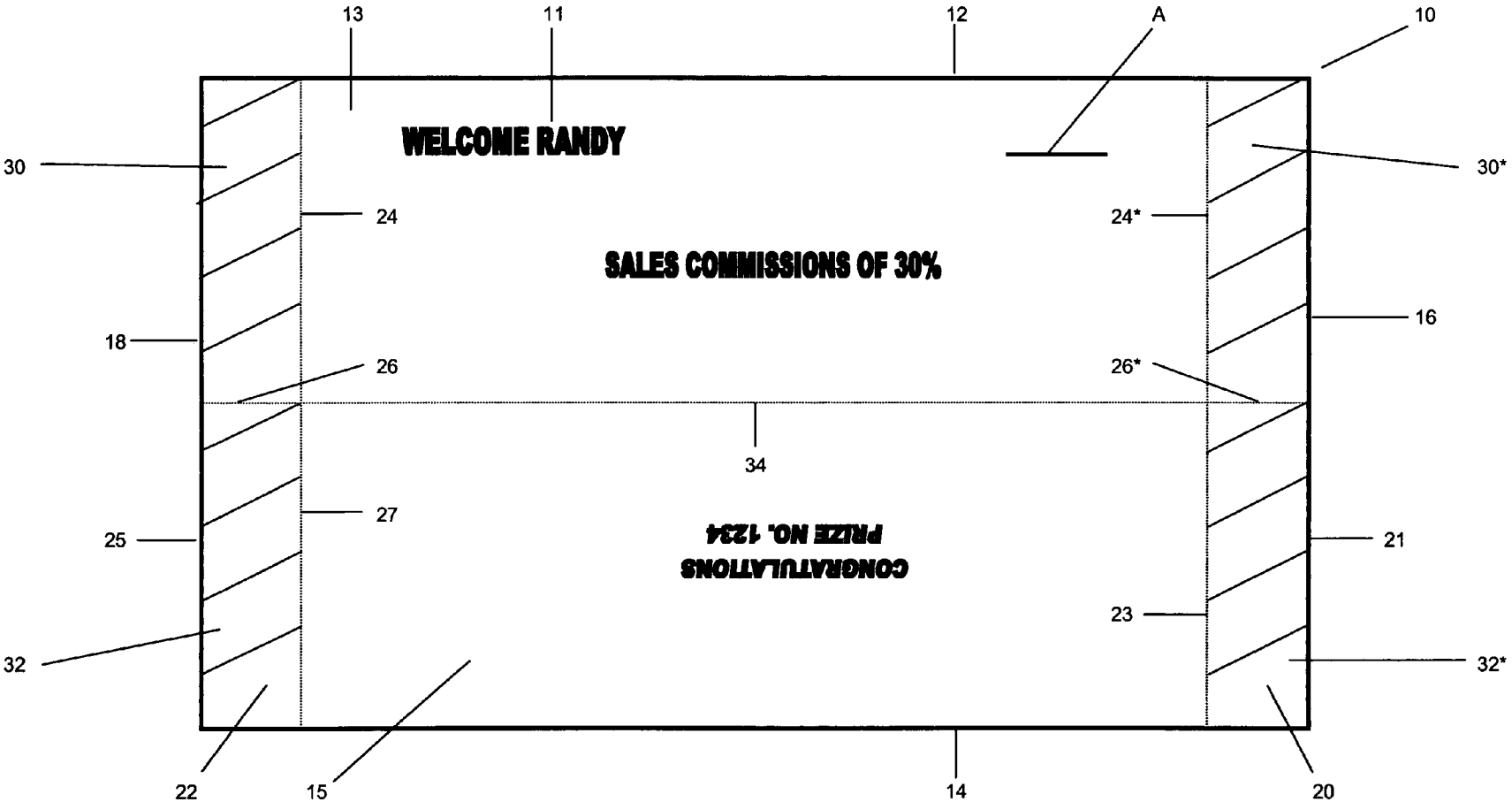
FIG. 1 depicts a front view of the sheet of material of the present invention useable in creating the on demand, personalized pocket.

The present invention is now illustrated in greater detail by way of the following detailed description, but it should be understood that the present invention is not to be construed as being limited thereto.

Unexpectedly, the inventor of the present invention has found that full use of the blank when creating a presentation folder can be made to convey a message. In addition, the sheet used in forming the pocket can be used to complement the message being presented thereby increasing the total amount of "landscape" available for communicating with the audience.

As used herein, the term "adhesive strips" includes, but is not limited to strips, patterns, segments, shapes, spots, continuous arrangements, discontinuous arrangements and combinations thereof. The type of adhesive that may be used includes but is not limited to repositionable, removable, permanent, remoistentable, hot melt, pressure seal (cohesive), cold glues and combinations and mixtures thereof. The present invention may also include adhesive strips that are provided in the form of transfer tapes, pressure sensitive tapes and the like which usually will have a removable release liner, which when removed will expose and activate the adhesive that can be used to form a sealing arrangement.

The term "document containment device" as used herein includes portfolios, notebooks, binders, clipboards, sleeves, folders, envelopes, accordion folders and the like.

The printing or imaging that can be provided on the blank as well as the sheet material forming the pocket can be personalized or individualized so that each attendee of a business meeting can receive a specially tailored message. For example, a normal introductory business meeting, the attendees from the target company (company that is being targeted for the sale of goods or services) may have an executive present, members of the sales and marketing team as well as production personnel in attendance to consider the information being provided. The presenter ideally wants to deliver a unique message to each person or group in the audience and is only offered a short period of time to accomplish this task, and usually devotes most of the period to "walking through" a visual presentation. However, through the use of the present invention, the presenter can deliver personalized or individualized information to each group while still focusing on delivering the information to the group. For example, information for sales and marketing may relate to increased sales and commissions or sales strategies for selling the product. Production personnel may receive information relating to efficient manufacturing techniques and other products for which the services may be used with as well as contact numbers for support and other technical data. The executive may only receive summary or overview information and financial numbers relating to the impact of the divisional bottom line. Thus each person is provided with a unique package of information that is tailored to his or her specific talents thereby potentially increasing the chances of success of the presentation.

Turning now to FIG. 1, the sheet of material suitable for use with the present invention is provided and generally designated by reference numeral 10. The sheet 10 may be any suitable material such as paper, plastic films, metalized films or any other material that can be used to accomplish the functions of the present invention. The sheet 10 has a first face designated by "A" and a second face (not shown) which will make up the interior of the pocket once the sheet if folded. Printing 11 is provided on face A and is personalized or individualize printing intended for the recipient or user of the pocket and is to be complimentary to indicia or printing provided on the folder blank or document containment device as will later be discussed herein. It should be understood that printing can be provided on both panels 13 and 15 or only on one of panels. When printing is provided on both panels 13 and 15, printing on one of the panels will appear upside down such that when the sheet 10 is folded, it will then appear right side up, as the panels 13 and 15 will be in a back to back configuration. Printing on the second panel may be useful when the pocket of the present invention is used in a hinged configuration as will be described in reference to FIGS. 3, 3A and 5 or alternatively, if the blank used in creating a presentation folder has a transparent or translucent quality.

The blank provided in FIG. 1 may be manufactured from a standard sheet size such as 8½" by 11". The panels after forming having a length of approximately 9 inches, with each of the end portions being roughly an inch wide, and having a height of around 4" to 4¼. The foregoing dimensions are used when preparing a standard configuration presentation folder. That is, each panel of the blank runs about 12" high and about 9" wide with the pocket having a length of about 9" and a height of around 4". Obviously, other dimensions are possible and would simply require the repositioning of the adhesive areas, lines of weakness, etc. on the sheet or use of different sized sheets of material. The pocket of the presently described embodiment is sized and configured so that it can receive and retain a standard size sheet of paper in a portrait arrangement (8½" side placed in the pocket which has a width of approximately 9").

As depicted in FIG. 1, the printing on the second panel 15 has been shown to contain information relating to a prize or award so that upon moving the pocket in its hinged configuration, the attendee can see if they won a prize. Alternative embodiment include the use of the second panel 15 for additional printable area to convey a message, coupons, contact information and any other information that may be suitable for inclusion with the particular message being presented.

The sheet 10 has first and second transversely extending edges 12 and 14, and first and second longitudinally extending edges 16 and 18. The sheet is also provided with first and second strips of adhesive 20 and 22. Each of the strips of adhesive 20 and 22 have first and second side edges 21, 23 and 25 and 27 which define the area of the adhesive. As indicated previously, the adhesive may be selected from any suitable type, and in the presently described embodiment, the adhesive strips are preferably pressure sensitive tapes that are provided with a release liner that can be removed at the time of folding and/or attachment to the blank to make up the presentation folder.

Figure 2:
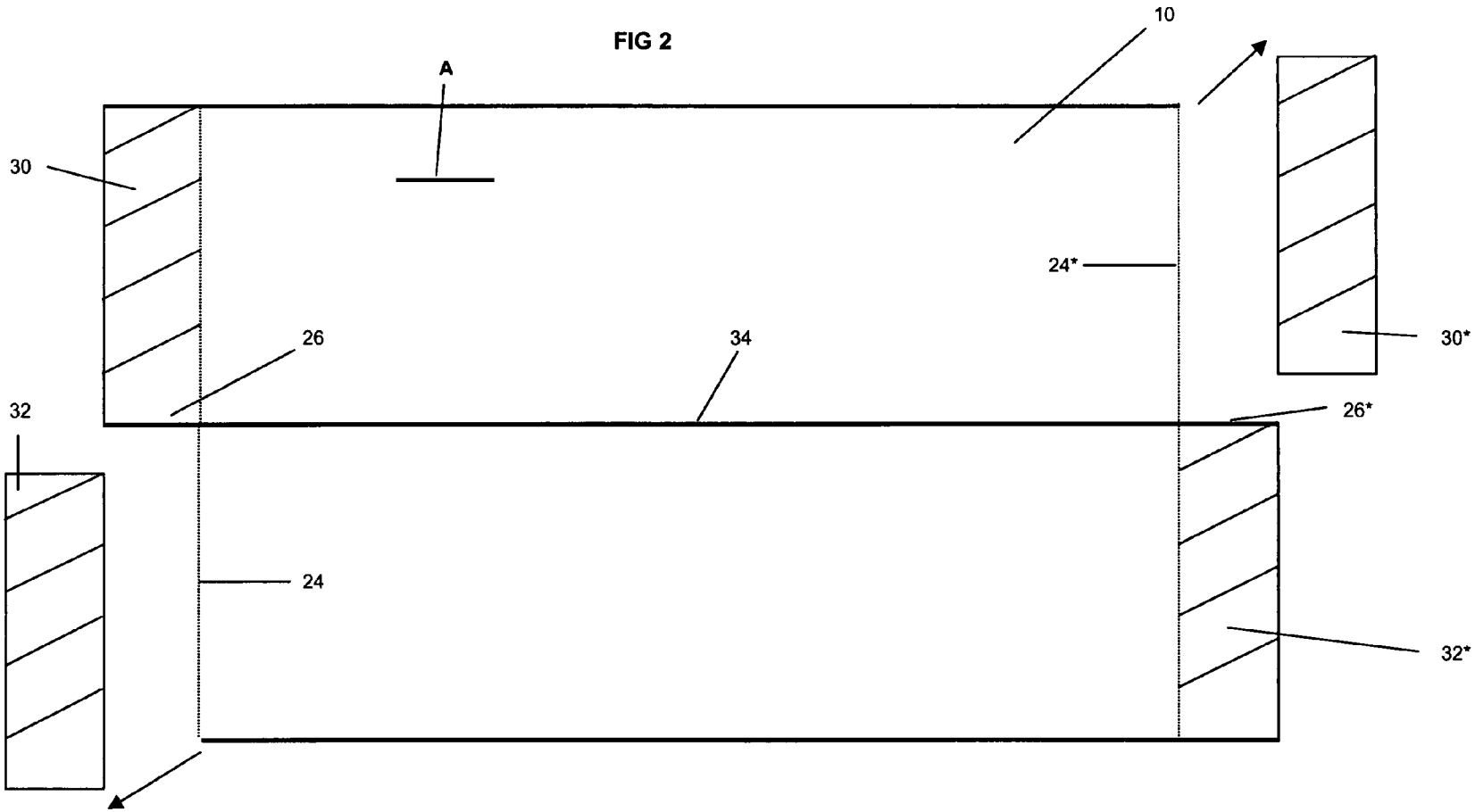
FIG. 2 shows the front view with the removable portions being in a detached condition in preparation of folding the sheet to create the on demand, personalized pocket of the present invention.

The sheet 10 is also provided with first and second lines of weakness 24, 24* and 26, 26*. The second lines of weakness 26 and 26* run substantially perpendicularly to the first lines of weakness 24 and 24* and cooperate with one another to create first and second sections in the adhesive strips designated by 30, 30* and 32, 32*. The lines of weakness 24, 24* and 26, 26* may be perforations, die cuts, score lines or any other means by which to assist in the folding and removal of portions of the sheet as will be described later in reference to FIG. 2.

The sheet 10 is also provided with a fold line 34. While FIG. 1 depicts the fold line substantially medially of the sheet, while the sheet is in a landscape position, it should be understood that the fold line 34 may appear in any portion of the sheet so as to create major and minor walls or portions (one larger than the other, that is one having more than 50% of the material). In addition, the sheet may appear in a portrait position or the fold line may run diagonally of the sheet so as to create other possible arrangements for the pocket of the present invention.

Turning now to FIG. 2, the sheet 10 is again provided with face A showing (the printing has been removed for clarity but it should be understood that the printing would typically be provided if it is intended to make up part of a presentation folder). One of the first and second sections of each of the adhesive strips 30* and 32 has been removed to create removable portions 30* and 32 which are discarded. The removable portions 30* and 32 are detached along lines of weakness 24* and 26* for removable portion 30* and lines 24 and 26 for removable portion 32. As can be seen from FIG. 2, the sections remaining 30 and 32* are provided with adhesive and are disposed at opposite corners from one another. Depending upon the orientation of the pocket (left or right attachment to the spine of a folder) to be formed, sections 30 and 32* could be removed and sections 30* and 32 remain with the construction. However, it is contemplated that the section should be at opposite corners or edges to one another so as to enable formation of the pocket as will be described herein.

Figures 3, 3A, 3B, 3C:
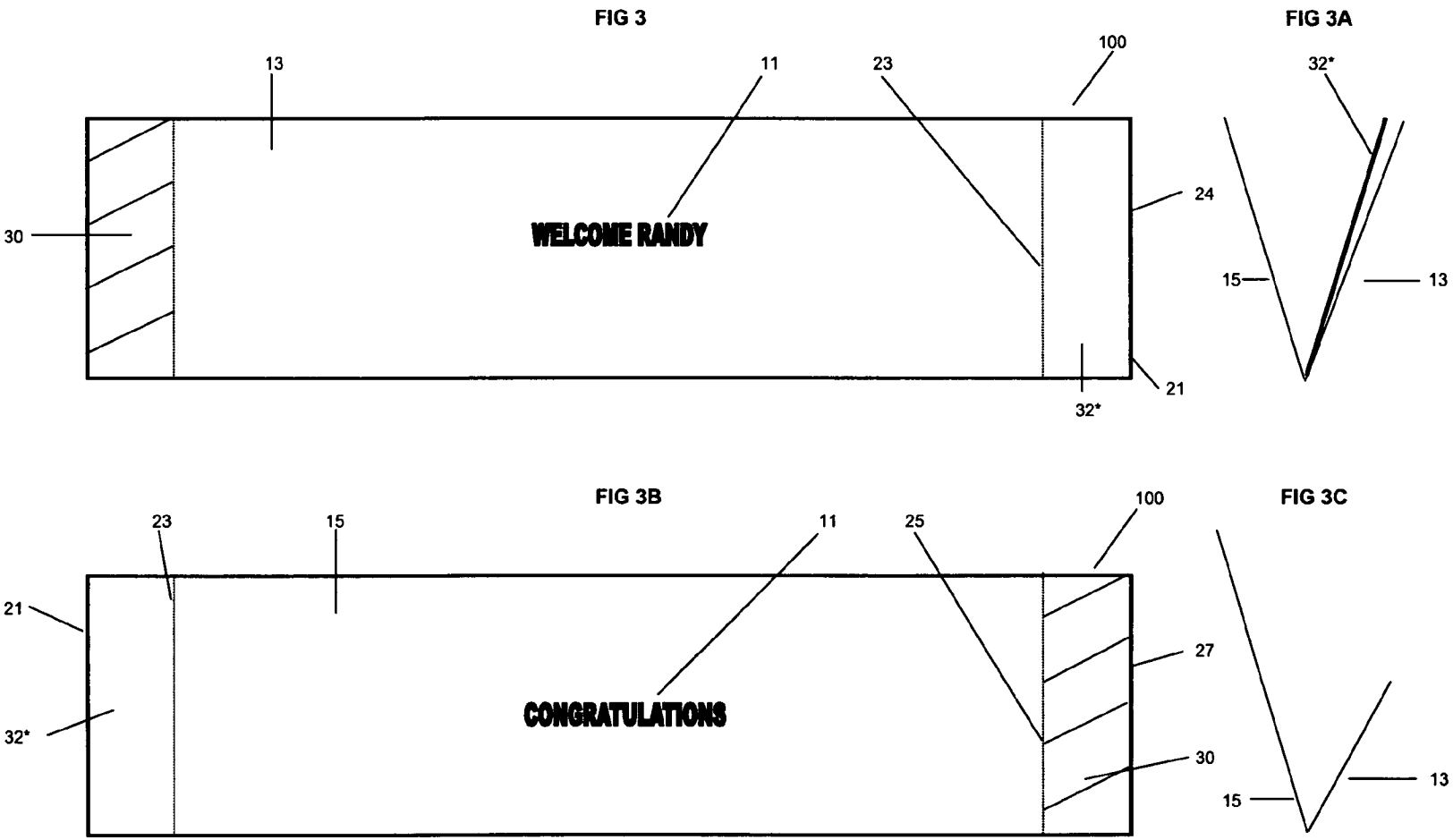
FIG. 3 illustrates one face or panel of the sheet in a folded condition.
FIG. 3A shows a side view of the sheet illustrating the adhesive contact between the interior faces of the sheet.
FIG. 3B provides the opposite face or panel of the folded sheet presented in FIG. 3.
FIG. 3C illustrates a further embodiment of the present invention and provides that sheet may be folded in such a manner so that one panel is larger than the other.

Reference is now directed to FIGS. 3 through 3B which show the sheet of the present invention folded into a pocket configuration. FIG. 3 shows panel 13, with printing 11 (as indicated in FIG. 1) provided thereon. Adhesive strip section 30 is shown with the adhesive strip still ready to use for attaching the pocket 100 to a blank or file containment device. Adhesive strip section 32* has been folded along line of weakness 24* so that it is in contact with the second face (not shown) of the sheet forming the pocket 100 thus sealing one end edge of the pocket together. The edge of the adhesive strip is depicted in phantom by reference numeral 23.

FIG. 3A illustrates the end of the pocket 100 just prior to sealing, panel 15 to panel 13. The adhesive on adhesive strip 32* is exposed such as by removal of the release liner and the adhesive strip 32* is folded about line of weakness 24*. Then inner faces of panels 13 and 15 are then brought into contact with one another in order to seal one edge of the pocket.

FIG. 3B shows panel 15 of the pocket 100, in which the edges of adhesive strip 30 are shown in phantom by reference to numerals 25 and 27 and the adhesive strip 32* defined by the lines 21 and 23. The adhesive strip 30, extends outwardly from the panel 15 and is still ready for use, while the adhesive strip 32* has been activated and is now in a sealing arrangement so as to form the pocket 100.

Referring briefly to FIG. 3C, an alternate embodiment of the present invention is provided and includes different sized panels 13 and 15 to illustrate that different arrangements of pockets can be produced in accordance wit the present invention.

Other combinations are of course possible in connection with forming the sheet of the present invention into a pocket for a presentation folder. For example, instead of the adhesive strips being along the short edge or side of the sheet of material, the adhesive strips could be applied along the long edge or side of the sheet. That is, instead of a pocket having dimensions of roughly 4" tall by 9" wide, the pocket could be 4" wide and 9" tall.

Figure 4:
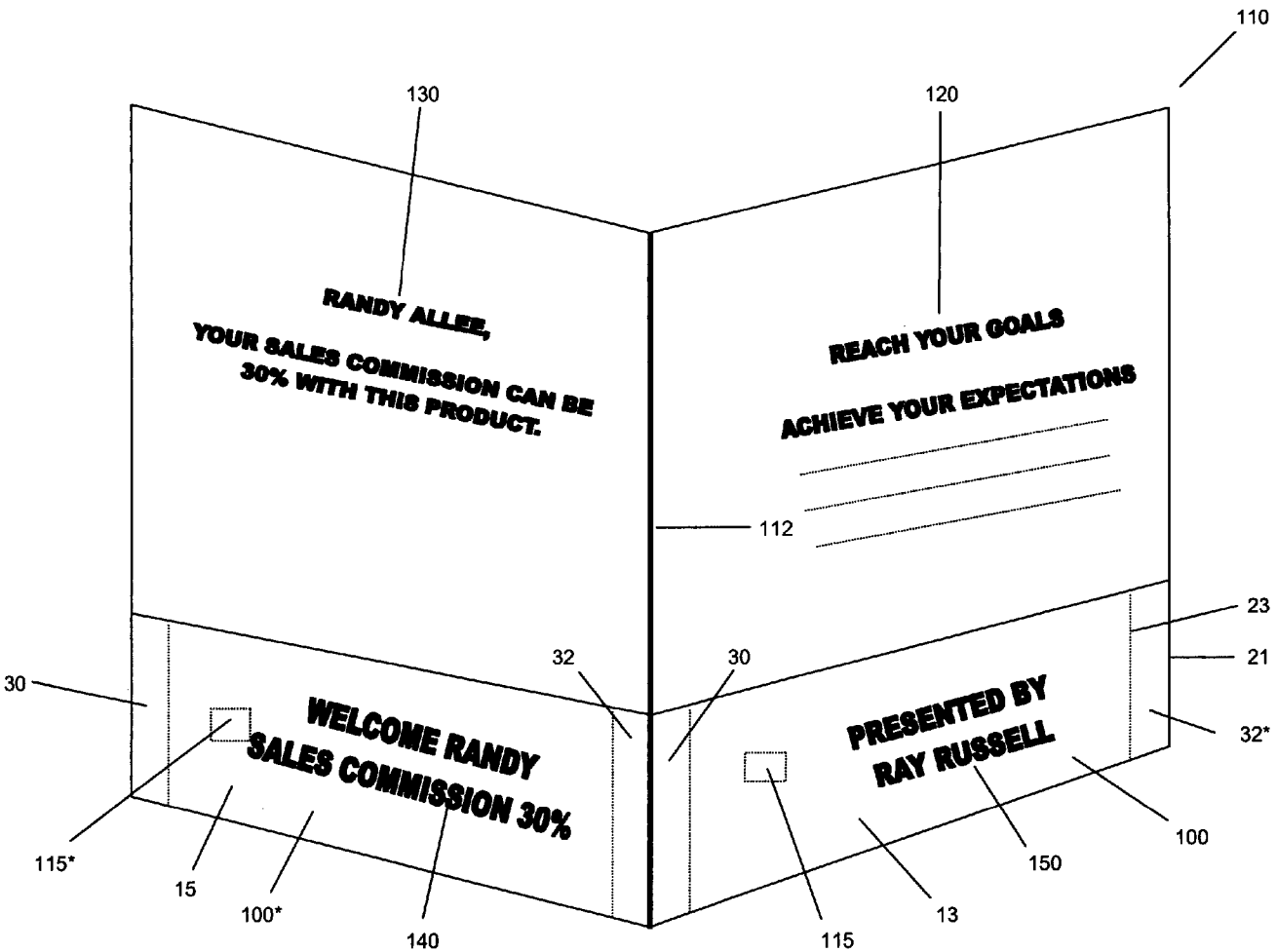
FIG. 4 depicts the use of plural pockets created by the sheet of the present invention and provides personalized information on the blank as well as on the on demand pockets of the present invention.

Turning now to FIG. 4, an opened presentation folder is provided and generally depicted by reference to numeral 110. Each side of the presentation folder has a dimension of roughly 9 inches wide by 12 inches tall. The folder itself is formed from a blank of stock material having overall dimensions of 18 inches wide by 12 inches tall. In this illustration, a pair of pocket 100 and 100* have been provided and attached to the presentation folder 110. The pockets 100 and 110 have been created as previously described in reference to FIGS. 3 through 3B, but is should be understood that the pockets have different opening orientations. That is, and again referring to FIG. 2, instead of removing portions 32 and 30*, those portions remain and instead portions 30 and 32* are removed, so that pockets 100 and 100* can have a left and right sealing/opening arrangement when provided in a hinged connection.

Each of the exposed faces of the presentation folder 110 has been provided with personalized or individualized indicia as demarcated by reference numerals 120, 130, 140 and 150. The indicia may be provided by any suitable means such as ink jet, laser printers or any other printing or imaging means that can receive data and apply variably printed information.

Referring to pocket 100, the adhesive section 32*, defined by 21 and 23 has been used to seal the end edge and adhesive section 30 has been used to attach the pocket 100 to the folder 110. The adhesive section 30, initially has the adhesive exposed, such as through the removal of a liner material and is then folded back so that the adhesive is in contact with the folder 110 along the area of the spine 112, thus securing the pocket 100 to the folder 110. It should be understood that the pocket 100 may be positioned anywhere on the folder, depending on the needs of the end user. In order to hold the pocket 100 in position, a spot of adhesive 115 is used. The adhesive spot 115 may be a repositionable or removable adhesive so that the pocket can be hinged. It should be understood that the closed end of the pocket 100 or 100* may be at either end or the hinge on the other end. If one elects not to use a hinge option then a spot of permanent adhesive or transfer tape can be used to permanently secure the pocket to the folder 110. Obviously, one could still utilize a removable or repostional adhesive and just not opt to use the hinge function provided by the present invention.

An alterative arrangement would be to use the adhesive sections 30 and 32* to simple seal the ends of the pocket 100 and then apply spots of adhesive to secure the pocket to the folder 110.

FIG. 4 also shows pocket 100* secured to the folder 110 and securement of the pocket 100* to the folder 110 is achieved similarly to that provided above. Pocket 100* provides panel 15 showing whereas pocket 100 has panel 13 facing the recipient.

Figure 5:
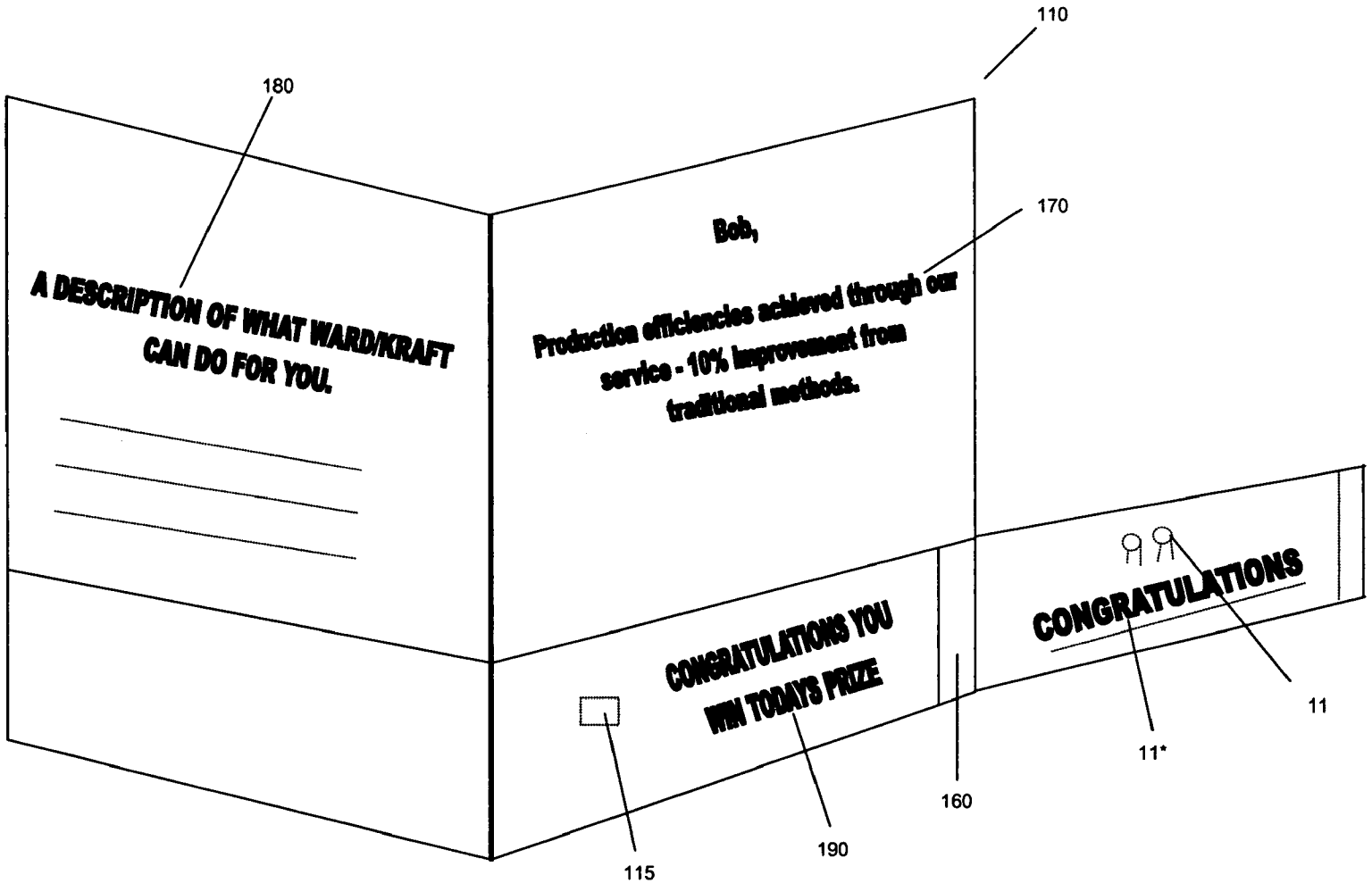
FIG. 5, shows the pocket of the present invention in a hinged configuration enabling the full printing of the blank and revealing other personalized information and demonstrating the blank is fully printable.

Turning now to FIG. 5 a single pocket presentation folder is provided and showing use of the pocket 100 in an opened configuration through use of hinge 160. The pocket 100 is provided with printing 11 on the front panel, shown in phantom, and printing 11* on the rear panel which reveals either part of a further message or a hidden message such as a prize award thus stimulating the recipient to look beneath the folded pocket.

The hinged pocket 100 as described earlier is connected to the folder 110 through the use of an adhesive 115, such as removable, repositional, and as already described. In this single pocket configuration, personalized indicia is also provided at 170, 180 and 190 so as to make the presentation look as if it was tailored to the specific recipient.

Figure 5A:
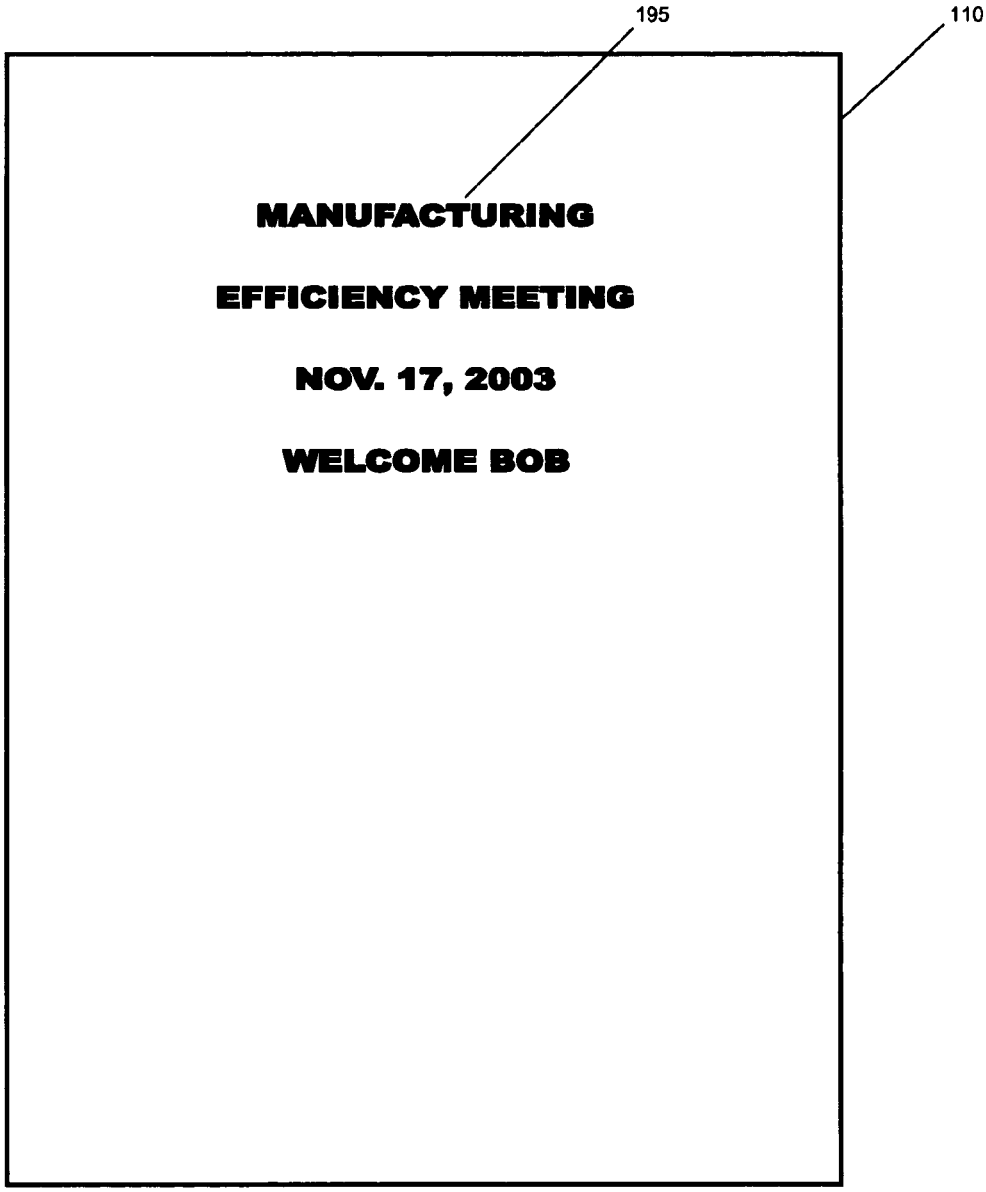
FIG. 5A depicts the cover of the blank and shows further personalization and the use of complimentary printed information to that which is printed on the sheet forming the pocket and blank.

Briefly, FIG. 5A shows an exterior cover of presentation folder 110 and is provided with additional printing or imaging that is unique to the attendee. This printing as well as the printing internally of the presentation folder 110 and pockets 100, 100*a* is complimentary, that each of the printed areas relates to other printed areas and is tied to the individual, product, person, etc. Obviously, certain areas can also have static or generic information if required by the end user.

Figure 6:
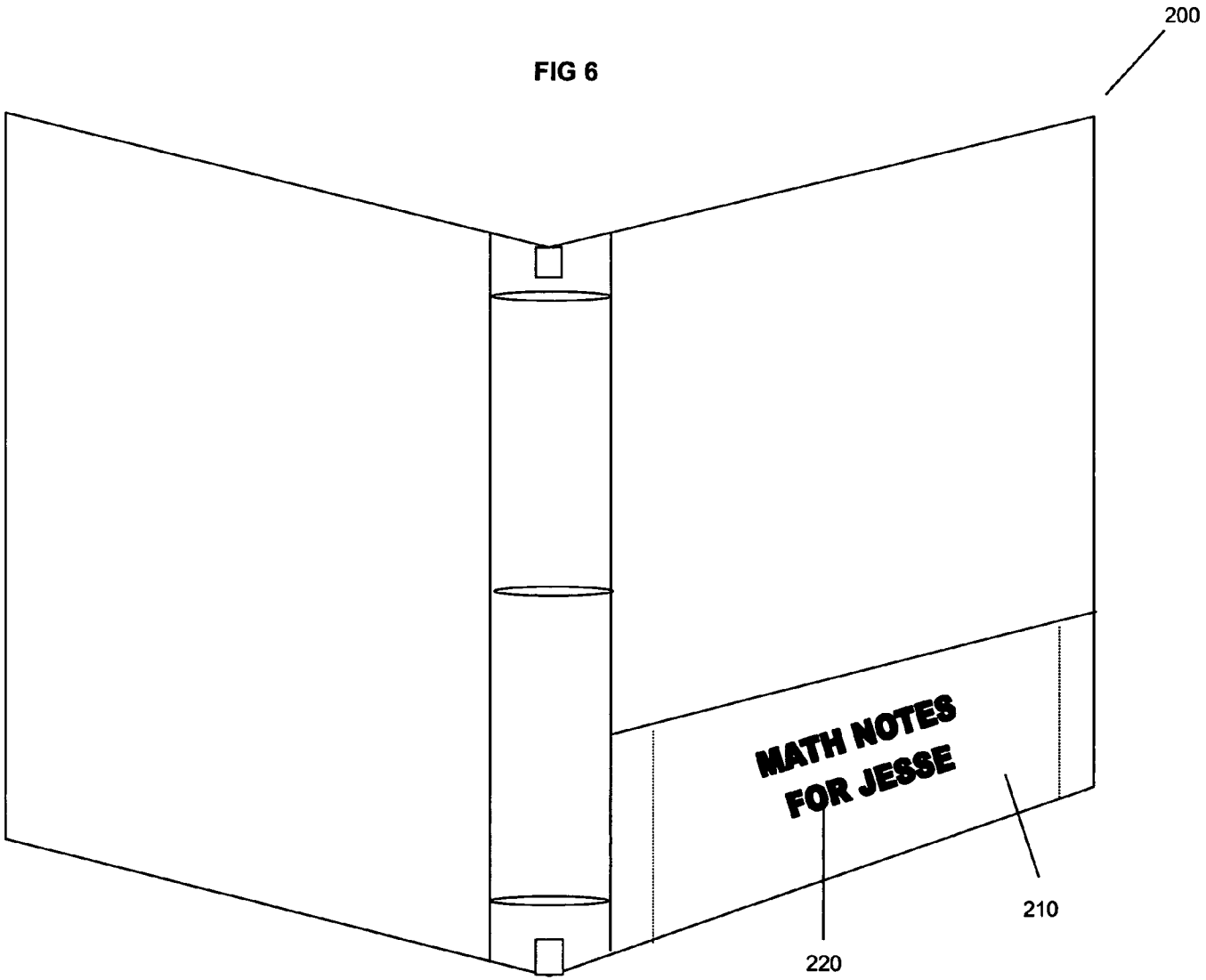
FIG. 6 illustrates the auxiliary pocket of the present invention being connected to a document containment device.

FIG. 6 shows the pocket of the present invention being used with a document containment device 200. Document containment devices include portfolios, notebooks, binders, clipboards, sleeves, folders, envelopes, accordion folders and the like. Here, FIG. 6 shows a conventional ring binder 200. The pocket 210 is connected to the binder 200 as has been previously been described and is provided with personalized information 220 related to the user of the pocket. In this embodiment, students, seminar attendees or the like can then customize their document containment devices to increase the functionality of such devices and create additional organizational capability for the users of such devices.

It will thus be seen according to the present invention a highly advantageous pocket system for presentation folders and the creation of auxiliary pockets has been provided. While the invention has been described in connection with what is presently considered to be the most practical and preferred embodiment, it will be apparent to those of ordinary skill in the art that the invention is not to be limited to the disclosed embodiment, that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

The invention claimed is:

1. A sheet for use in creating a pocket for a personalized presentation folders, comprising;

a blank of material sized and configured to provide a presentation folder and suitable for processing through a printing means capable of producing variable print;

a sheet of material capable for receiving printing or imaging, said sheet having a first face and a second face and first and second transversely extending edges and first and second longitudinally extending edges;

at least first and second strips of adhesive disposed adjacent one of said first and second transversely extending edges or said first and second longitudinally extending edges, each of said first and second strips of adhesive having first and second edges;

at least first and second lines of weakness, said first line of weakness disposed along one of said first and second edges of each of said first and second strips of adhesive;

said second line of weakness disposed substantially perpendicularly to said first line of weakness and running from said first edge to said second edge of each of said first and second strips of adhesive;

a fold line running between one of said first and second transversely extending edges or said first and second longitudinally extending edges defining first and second panels which are folded about said fold line to create the pocket along with at least one of said first and second strips of adhesive; and said sheet with said first and second strips of adhesive, fold line and lines of weakness being formed into a pocket which can be attached to said blank.

2. A sheet for use in creating a pocket for folders as recited in claim 1, wherein said second line of weakness runs parallel to said fold line.

3. A sheet for use in creating a pocket for folders as recited in claim 1, wherein said fold line is disposed substantially medially of said sheet.

4. A sheet for use in creating a pocket for folders as recited in claim 1, wherein said strips of adhesive are selected from a group that include segments, spots, patterns, continuous arrangements, discontinuous arrangements and combinations thereof.

5. A sheet for use in creating a pocket for folders as recited in claim 1, wherein said strips of adhesive are selected from repositional, removable, permanent, remoistenable, hot melt, pressure seal cohesives, cold glues and combinations and mixtures thereof.

6. A sheet for use in creating a pocket for folders as recited in claim 1, wherein said lines of weakness are selected from a group including perforations, die cuts, score lines and combinations thereof.

7. A sheet for use in creating a pocket for folders as recited in claim 1, wherein each of said strips of adhesive have a width less than a width of said sheet.

8. A sheet for use in creating a pocket for folders as recited in claim 1, wherein said second line of weakness divides each of said first and second strips of adhesive into first and second sections.

9. A sheet for use in creating a pocket for folders as recited in claim 8, wherein each of said first and second sections are substantially equal.

10. A sheet for use in creating a pocket for folders as recited in claim 8, wherein one of said first and second sections has a length greater than another of said first and second sections.

11. A sheet for use in creating a pocket for folders as recited in claim 1, wherein said first and second lines of weakness cooperate to form first and second removable portions along each of one of said first and second transversely extending edges or said first and second longitudinally extending edges.

12. A sheet for use in creating a pocket for folders as recited in claim 11, wherein one of said first and second removable portions is removed from each of said one extending edges of said sheet prior to forming said pocket.

13. A sheet for use in creating a pocket for folders as recited in claim 12, wherein said removed sections of each of said extending edges are at opposite corners of said sheet.

14. A sheet for use in creating a pocket for folders as recited in claim 1, wherein said fold line is used to create first and second folder pocket walls.

15. A sheet for use in creating a pocket for folders as recited in claim 14, wherein said first and second pocket walls are substantially equal in size.

16. A sheet for use in creating a pocket for folders as recited in claim 14, wherein said first and second pocket walls are unequal in size.

17. A personalized presentation folder having at least one pocket formed from a separate sheet of material, comprising;

a blank of material sized and configured to provide a presentation folder and suitable for processing through a printing means capable of producing variable print;

a separate sheet of material capable of receiving printing or imaging and for forming the pocket, said sheet having a first face and a second face and first and second transversely extending edges and first and second longitudinally extending edges;

at least first and second strips of adhesive disposed adjacent one of said first and second transversely extending edges or said first and second longitudinally extending edges, each of said first and second strips of adhesive having first and second edges;

at least first and second lines of weakness, said first line of weakness disposed along one of said first and second edges of each of said first and second strips of adhesive;

said second line of weakness disposed substantially perpendicularly to said first line of weakness and running from said first edge to said second edge of each of said first and second strips of adhesive;

a fold line running between one of said first and second transversely extending edges or said first and second longitudinally extending edges; and said sheet with said first and second strips of adhesive, fold lines and lines of weakness being formed into a pocket which can be attached to said blank.

18. A personalized presentation folder having at least one pocket formed from a separate sheet of material as recited in claim 17, wherein said printing applied to said blank and said sheet contains personalized or individualized information.

19. A personalized presentation folder having at least one pocket formed from a separate sheet of material as recited in claim 18, wherein said printing on said blank and said sheet is complimentary to one another.

* * * * *